US010149592B2

(12) United States Patent
Amicon

(10) Patent No.: US 10,149,592 B2
(45) Date of Patent: Dec. 11, 2018

(54) SWEPT BRUSH ASSEMBLY

(71) Applicant: Kenneth Amicon, New Albany, OH (US)

(72) Inventor: Kenneth Amicon, New Albany, OH (US)

( * ) Notice: Subject to any disclaimer, the term of this patent is extended or adjusted under 35 U.S.C. 154(b) by 369 days.

(21) Appl. No.: 14/846,351

(22) Filed: Sep. 4, 2015

(65) Prior Publication Data

US 2015/0374199 A1 Dec. 31, 2015

Related U.S. Application Data

(63) Continuation of application No. 13/724,116, filed on Dec. 21, 2012, now Pat. No. 9,125,482.

(60) Provisional application No. 61/579,417, filed on Dec. 22, 2011, provisional application No. 61/608,905, filed on Mar. 9, 2012.

(51) Int. Cl.

| | |
|---|---|
| ***A46B 3/18*** | (2006.01) |
| ***A47L 15/00*** | (2006.01) |
| *A46B 9/02* | (2006.01) |
| *A46B 7/04* | (2006.01) |

(52) U.S. Cl.

CPC ..... *A47L 15/0068* (2013.01); *A46B 3/18* (2013.01); *A46B 7/04* (2013.01); *A46B 7/046* (2013.01); *A46B 9/02* (2013.01); *A46B 2200/3006* (2013.01)

(58) Field of Classification Search

CPC ..... A46B 3/18; A46B 2200/3006; A47L 15/0068; A47L 17/04

USPC ..... 15/206, 207, 70, 75, 71, 76

See application file for complete search history.

(56) References Cited

U.S. PATENT DOCUMENTS

| | | | | |
|---|---|---|---|---|
| 1,083,829 A | | 1/1914 | Hatosy, Jr. | |
| 1,436,361 A | | 11/1922 | Seeley | |
| 1,513,339 A | * | 10/1924 | Merrihew | A46B 3/18 15/206 |
| 1,663,778 A | * | 3/1928 | Seeger | A45D 24/30 132/120 |
| 1,757,366 A | * | 5/1930 | Hertzberg | A47L 17/04 15/114 |
| 1,759,216 A | * | 5/1930 | Anderson | A46B 11/063 401/286 |
| 2,049,365 A | | 11/1935 | Follett | |
| 2,070,393 A | * | 2/1937 | Cave | A46B 17/08 15/206 |
| 2,707,296 A | | 5/1955 | Silverstein et al. | |
| 3,027,583 A | * | 4/1962 | Bain | A47L 15/0068 15/164 |
| 3,088,150 A | | 5/1963 | Sweeney | |

(Continued)

FOREIGN PATENT DOCUMENTS

EP 0498264 A1 * 8/1992 ..... A46B 9/02

*Primary Examiner* — Laura C Guidotti

(74) *Attorney, Agent, or Firm* — Benesch Friedlander Coplan & Aronoff LLP

(57) ABSTRACT

The exemplary embodiments provide a device for cleaning a drinking glass having interior and exterior surfaces where the device includes a body having a top and bottom. The device preferably includes an elongate member which contains a first portion that contacts the interior surfaces of the glass while a second portion contacts the exterior surfaces of the glass. The elongate member preferably has a plurality of bristles extending therefrom. In some embodiments, the elongate member is similar to a pipe cleaner.

8 Claims, 20 Drawing Sheets

(56) References Cited

U.S. PATENT DOCUMENTS

| | | | | |
|---|---|---|---|---|
| 3,271,806 | A | 9/1966 | Helmken | |
| 4,751,761 | A | 6/1988 | Breitschmid | |
| 5,606,759 | A | 3/1997 | Yang | |
| 5,621,941 | A * | 4/1997 | Liu | A46B 7/10 15/106 |
| 9,125,482 | B2 | 9/2015 | Amicon | |
| 2011/0289711 | A1 * | 12/2011 | Sgroi, Jr. | A47L 13/38 15/209.1 |

* cited by examiner

SWEPT BRUSH ASSEMBLY

CROSS-REFERENCE TO RELATED APPLICATIONS

This patent application is a continuation of and claims priority to U.S. application Ser. No. 13/724,116 filed on Dec. 21, 2012, now U.S. Pat. No. 9,125,482, which claimed priority to U.S. Provisional Patent Application Nos. 61/579,417, filed Dec. 22, 2011, and 61/608,905, filed Mar. 9, 2012; all of the above applications are hereby incorporated by reference as if fully rewritten herein.

TECHNICAL FIELD

The exemplary embodiments provided are in the field of cleaning and particularly in the field of implements for cleaning dishware.

BACKGROUND

Conventional restaurant drinking vessel cleaning arrangements employ a group of independent brushes that rotate by means of a motorized drive system. Often the brushes are arranged in a pattern of 5 brushes, one in the middle and the rest arranged around the center brush like the points of a compass. The design intends for the user to hold a drinking vessel on the center brush and all five rotate thereby washing the inside (center brush) and the outside (the other 4 brushes) at the same time. One such arrangement can be seen in FIG. 1. This design, however, has drawbacks.

Often in actual use, the user will place two drinking vessels simultaneously—one on each of the two side brushes—and rotate the drinking vessels one with each hand, in order to clean the drinking vessels. In this arrangement, the two side brushes clean the insides of their respective drinking vessels and the center cleans the outside of both. This is done in order to increase throughput so that a bartender, for example, can get back to the business of serving drinks, rather than cleaning drinking vessels. This practice actually only employs the middle 3 brushes as the top and bottom brushes are not designed to reach drinking vessels in this manner. Thus, this practice actually wastes energy by spinning the top and bottom brushes needlessly, and likely results in suboptimal cleaning of the drinking vessels as the arrangement is not being used as intended.

SUMMARY

Therefore, it is an object of the invention to provide a device of the type disclosed above which avoids the disadvantages inherent in conventional systems. In particular, the device is to be lightweight enough to be operated with one hand, capable of operation at variable speeds and a range of torques for assisting in the cleaning of various levels of residues, be replaceable/washable so as to be cleaned itself after use, and be sufficiently elongated to allow for the cleaning of tight interior cavities, of the size that are typical in drinking vessels.

In an embodiment, the device comprises a central base member and a plurality of brush arms extending upward from the base member. The brush arms comprise a spacing member and an upwardly extending support member. Optionally, the brushes comprise bristles along the interior surface of the spacing member, along the interior surface of the support member, or both.

In another embodiment, the device comprises a central brush and a plurality of substantially parallel outer brushes. The outer brushes may be positioned at n/360 degrees apart about a circle centered on the central brush, where n is the number of outer brushes. The brushes are comprised of a central post made from a durable material such as metal or hard plastic. The central brush extends upward from the central base member, the base member providing the operational interface between a motor unit and the remainder of the device. Optionally, the outer brush arms extend outward from the base member via spacing members, the spacing members connect the upwardly extending support members of the brush arms to the base member and dictate the spacing of the outer brushes from the central brush so that the device can accommodate, for example, a drinking vessel in between the outer brushes when the drinking vessel is placed over the central brush. The upwardly extending support members of the outer brushes extend upward from their respective spacing member in a parallel relationship to the central brush. In one embodiment, the outer brushes further comprise a hinge near the intersection of the upwardly extending support member and spacing member such that the upwardly extending support member can rotate relative to the spacing member to accommodate, for example, the presence of a handle on a drinking vessel when the device is spinning while cleaning the drinking vessel without breaking either the handle or the device.

BRIEF DESCRIPTION OF THE DRAWINGS

A better understanding of the exemplary embodiments of the invention will be had when reference is made to the accompanying drawings, wherein identical parts are identified with identical reference numerals, and wherein.

DETAILED DESCRIPTION

The terms "a" and "an" and "the" and similar references used in the context of describing the disclosed embodiments (especially in the context of the following claims) are to be construed to cover both the singular and the plural, unless otherwise indicated herein or clearly contradicted by context.

Conventional submersible drinking vessel cleaners while effective are widely considered inefficient. These systems often include a system of brushes simultaneously rotating but are designed to only clean one drinking vessel at a time. This throughput is slower than what is necessary in a restaurant or food service setting. Thus, users often modified their use of the system holding two drinking vessels on outside scrubbers (thus cleaning the inside of the drinking vessels with brushes designed to clean the outer surface) and rotating the drinking vessels by hand in an attempt to thoroughly clean the drinking vessels, using the central brush to clean the exterior surfaces of both drinking vessels simultaneously. While providing better throughput, this use delivers substandard cleaning due to using the system in a manner it was not designed for. Such use oftentimes fails to completely clean the drinking vessel (e.g., lipstick remains on the exterior lip of the drinking vessel). Because the human wrist can only rotate through a limited arc, the drinking vessel does not get fully rotated through 360 degrees during the cleaning process and as such there are regions on the drinking vessel that are not contacted by a brush during the cleaning operation. Closer, direct and more consistent contact with the exterior of the drinking vessels is therefore necessary for acceptable cleaning.

Figure 1A:
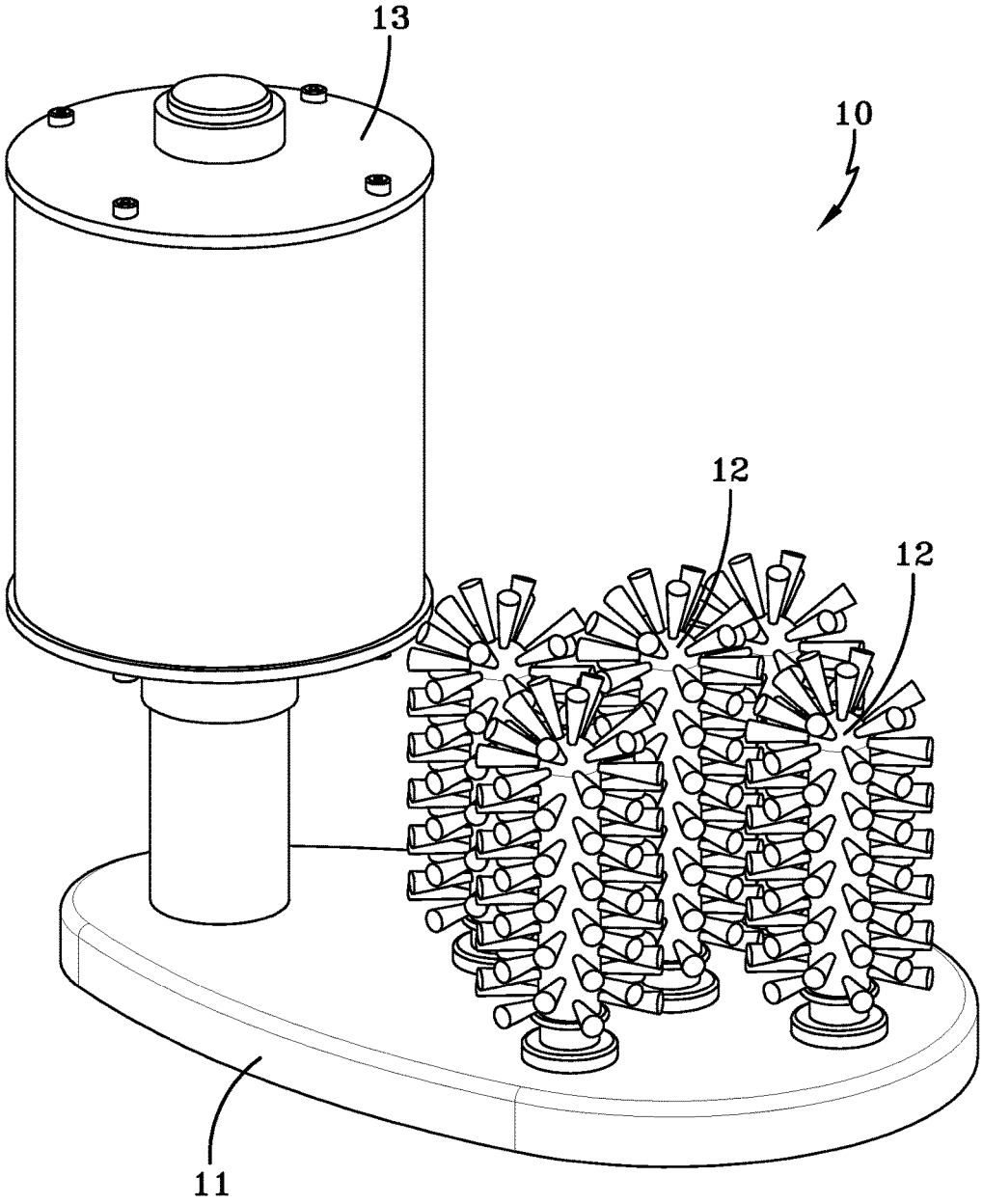
FIG. 1*a* is an illustration of a conventional submersible drinking vessel cleaner having five brushes, a central brush and four outside brushes.
Figure 1B:
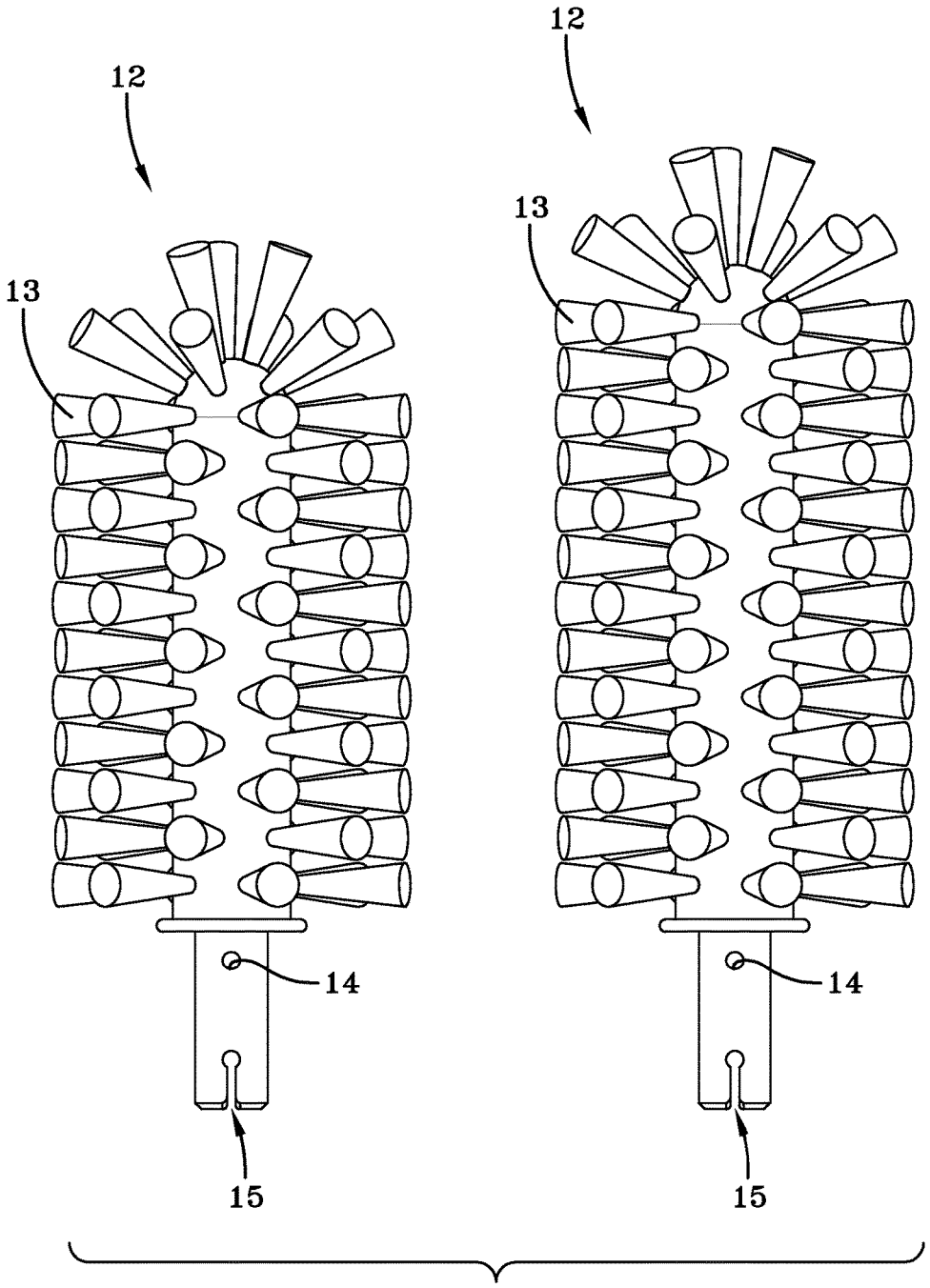
FIG. 1*b* shows two different standard brush sizes used with the submersible drinking vessel cleaner shown in FIG. 1*a*.
Figure 1C:
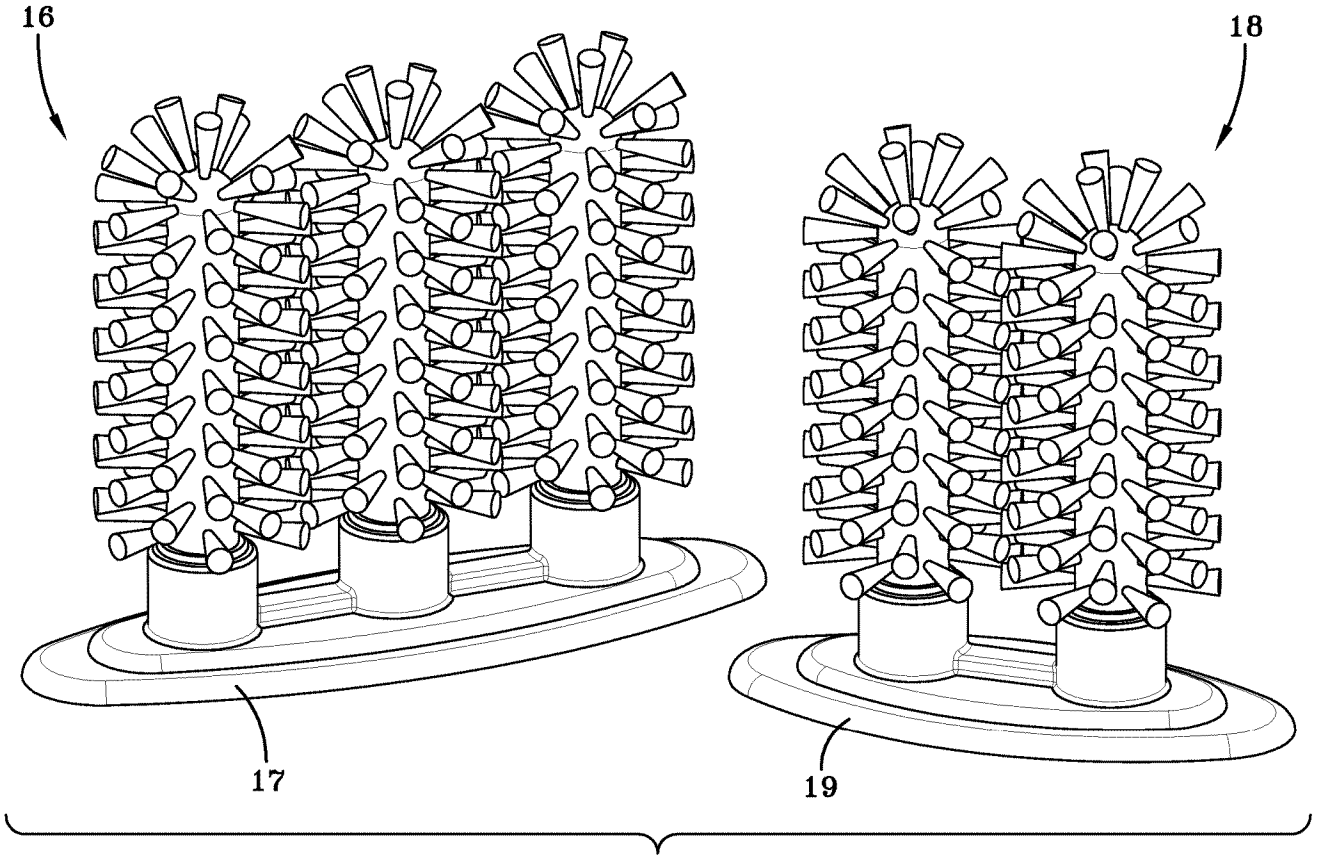
FIG. 1*c* shows two static glass cleaners providing a three-brush and a two-brush arrangement.

FIG. 1*a* shows a conventional submersible drinking vessel cleaner 10. The system comprises a base module 11 and five removably attached brushes 12, the base includes a motor 13 adapted to rotate the individual brushes. FIG. 1*b* shows two individual brushes 12 each having a series of bristle sets 13 positioned along its length. The bristle sets are attached to the brush in a series of ports 14 along the length. Often the brushes are removably attached to the base via a fork or clamp member 15 on the bottom of the brush, the individual members mate with rotating horizontal posts in the base module transferring the rotational force from the motor to the individual brushes. FIG. 1*c* shows two static submersible drinking vessel cleaners, 16 and 18. In static submersible drinking vessel cleaner 16, three brushes 12 are secured to static base unit 17. In static submersible drinking vessel cleaner 18, two brushes 12 are secured to static base unit 19.

Figure 2:
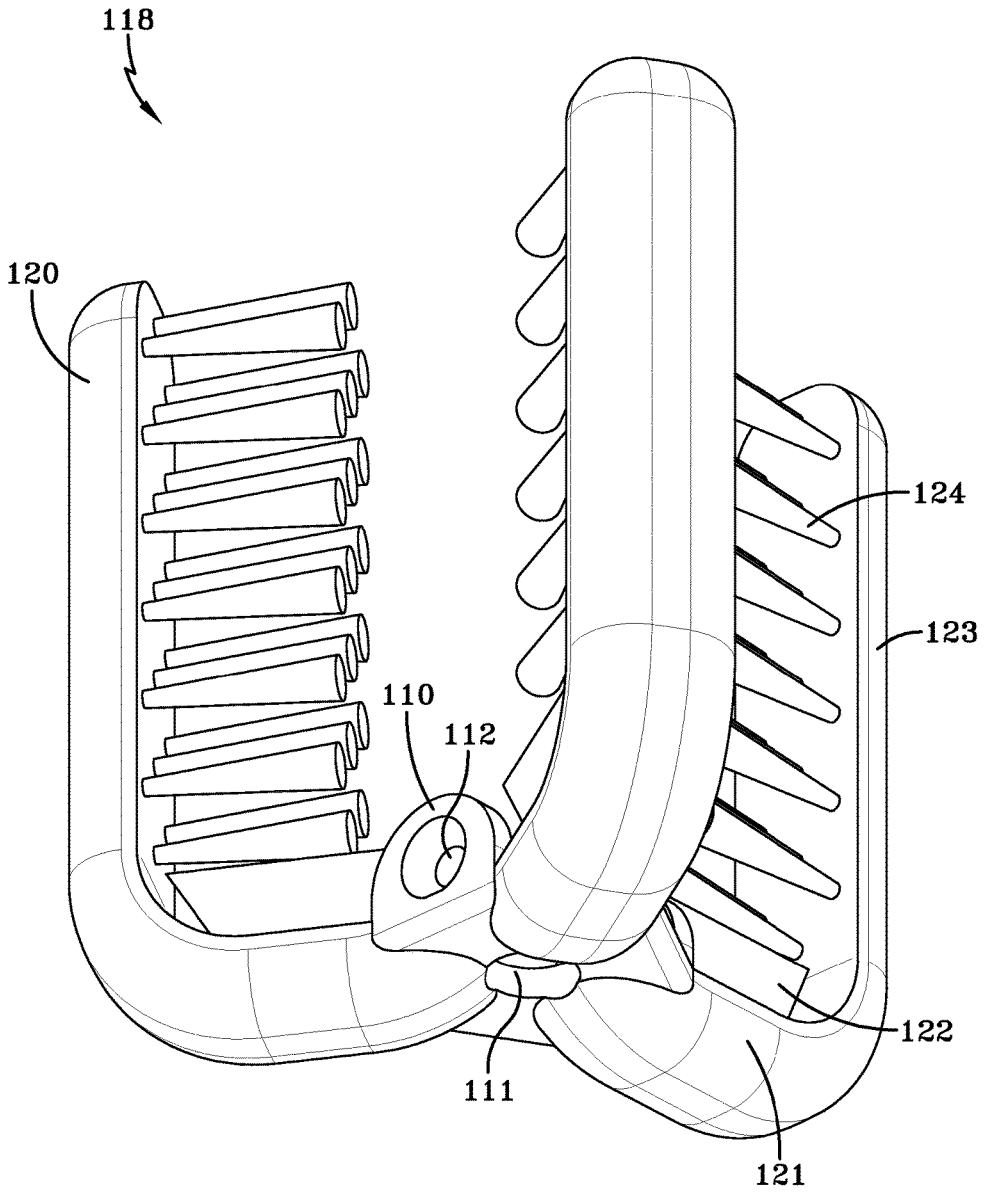
FIG. 2 is a perspective view of a three-armed embodiment of a supplemental brush device.

FIG. 2 shows a three-armed embodiment of a supplemental brush device 118. Supplemental brush device 118 has a base member 110 and three brush arms 120. Each brush arm comprises a spacing member 121 and an upwardly extending support member 123. The base member has a passage 111 extending therethrough into which a brush 12 from a conventional submersible drinking vessel cleaner may be inserted. The base member further possesses a hole 112 into which a pin is inserted that registers with a port 14 on brush 12 resulting from the removal of a bristle set so that the supplemental brush 118 is affixed to brush 12 in such a fashion that the supplemental brush 118 and brush 12 rotate as a single unit. The upwardly extending support members 123 may each have a plurality of bristle sets 124 attached thereto. Additionally, the spacing members 121, may also have a plurality of bristle sets 122 attached thereto. It should be apparent that the three-armed embodiment shown in FIG. 2 represents only one of a multitude of possibilities for the number of brush arms that may be attached to the base member. That is to say, two-arm, four-arm, and n-arm (where n is an integer) arrangements are also possible. Optionally, the brush 12 and supplemental brush device 118 may be integrally formed from a plastic or other suitable member to eliminate the need for the pin and for the use of port 14.

Because the supplemental brush 118 is fixedly attached to brush 12, the assembly (118 and 12) rotate as a single unit when used on base module 11 thereby allowing the simultaneous cleaning of the interior and exterior of a drinking vessel and because more than one such assembly can be used on a base module, a user can simultaneously wash more than one drinking vessel at a time.

Figure 3:
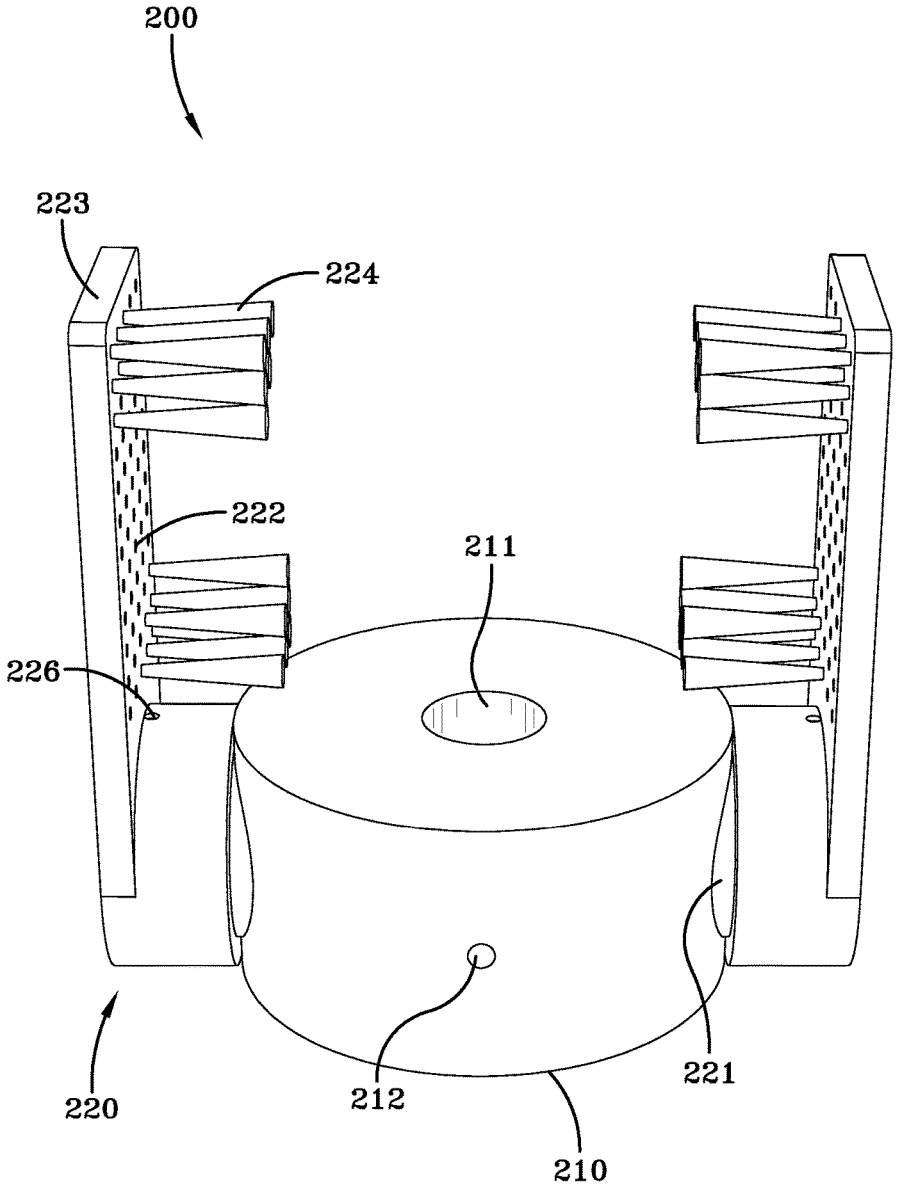
FIG. 3 is a perspective view of an alternative embodiment of a two-armed supplemental brush device.

FIG. 3 shows a perspective view of a two-armed embodiment of a supplemental brush device 200. Supplemental brush device 200 has a base member 210 and two brush arms 220. Each brush arm comprises a spacing member 221 and an upwardly extending support member 223. The base member has a passage 211 extending therethrough into which a brush 12 from a conventional submersible drinking vessel cleaner may be inserted. The base member further possesses a hole 212 into which a pin can be inserted that registers with a port 14 on brush 12 resulting from the removal of a bristle set so that supplemental brush 200 is affixed to brush 12 in such fashion that the supplemental brush 200 and brush 12 rotate as a single unit. The upwardly extending support members 223 may each have a plurality of holes 222 into which bristles sets 224 are inserted. Additionally, each brush arm has a hole 226 that interacts with a torsion spring (see FIG. 9) located inside of the intersection of the upwardly extending support member and the spacing member that brings the upwardly extending member back to an upright position after the brush arm has rotated from its upright position (by, for example, coming into contact with a handle on a drinking vessel during the cleaning process). Optionally, the brush 12 and supplemental brush device 200 may be integrally formed from a plastic or other suitable member to eliminate the need for the pin and for the use of port 14.

Because the supplemental brush 200 is fixedly attached to brush 12, the assembly (200 and 12) rotate as a single unit when used on base module 11 thereby allowing the simultaneous cleaning of the interior and exterior of a drinking vessel and because more than one such assembly can be used on a base module, a user can simultaneously wash more than one drinking vessel at a time.

Figure 4:
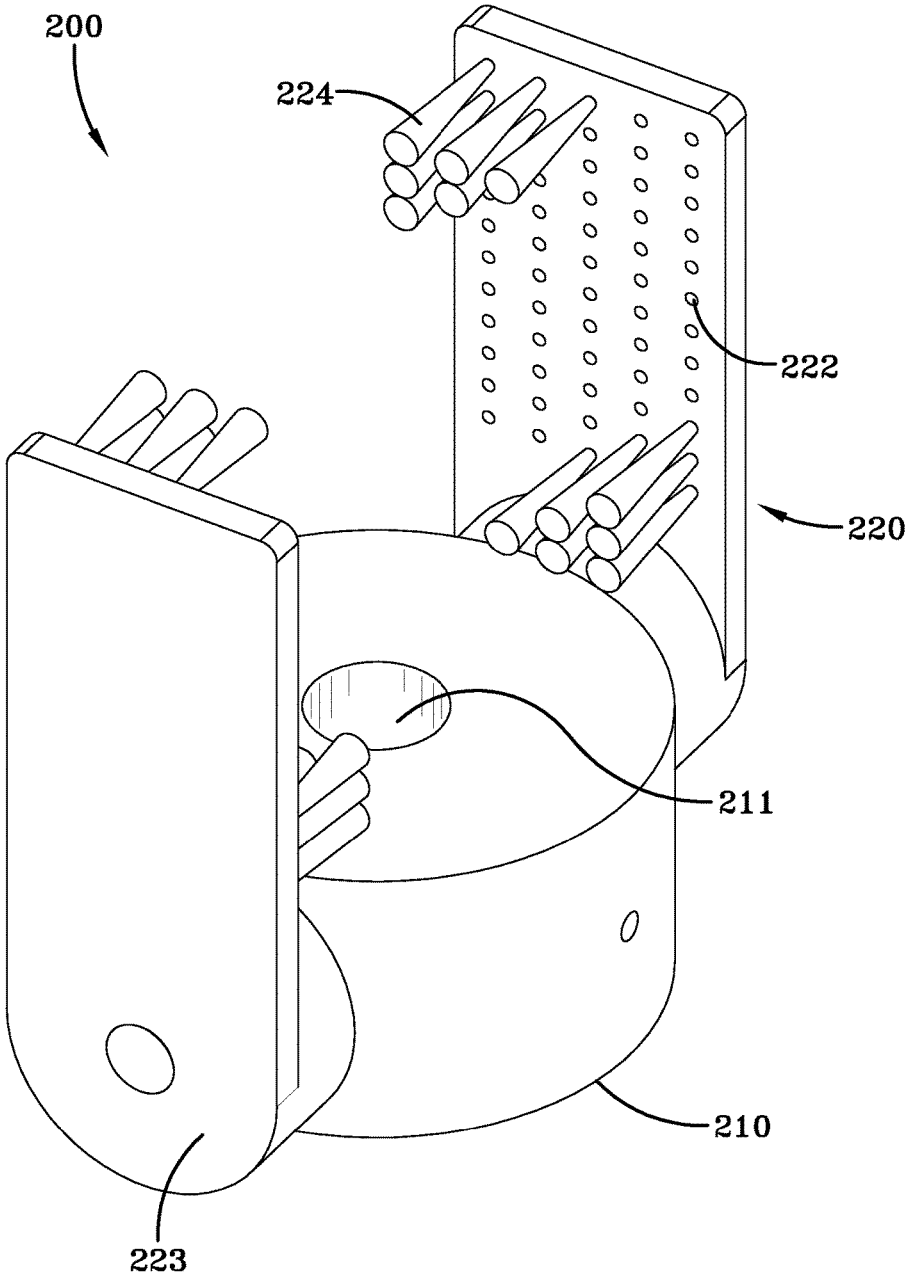
FIG. 4 is a second perspective view of the alternative embodiment of the two-armed supplemental brush device shown in FIG. 3.

FIG. 4 shows a second perspective view of the two-armed supplemental brush shown in FIG. 3. The arrangement of the bristle sets 224 is determined by the position of the plurality of holes 222 and is not restricted to the five-by-four arrangement on the interior surface of the upwardly extending support member indicated in FIG. 4. Rather, the bristles sets may be disposed on upwardly extending support member 223 in any configuration and on any surface of the upwardly extending support member.

Figure 5:
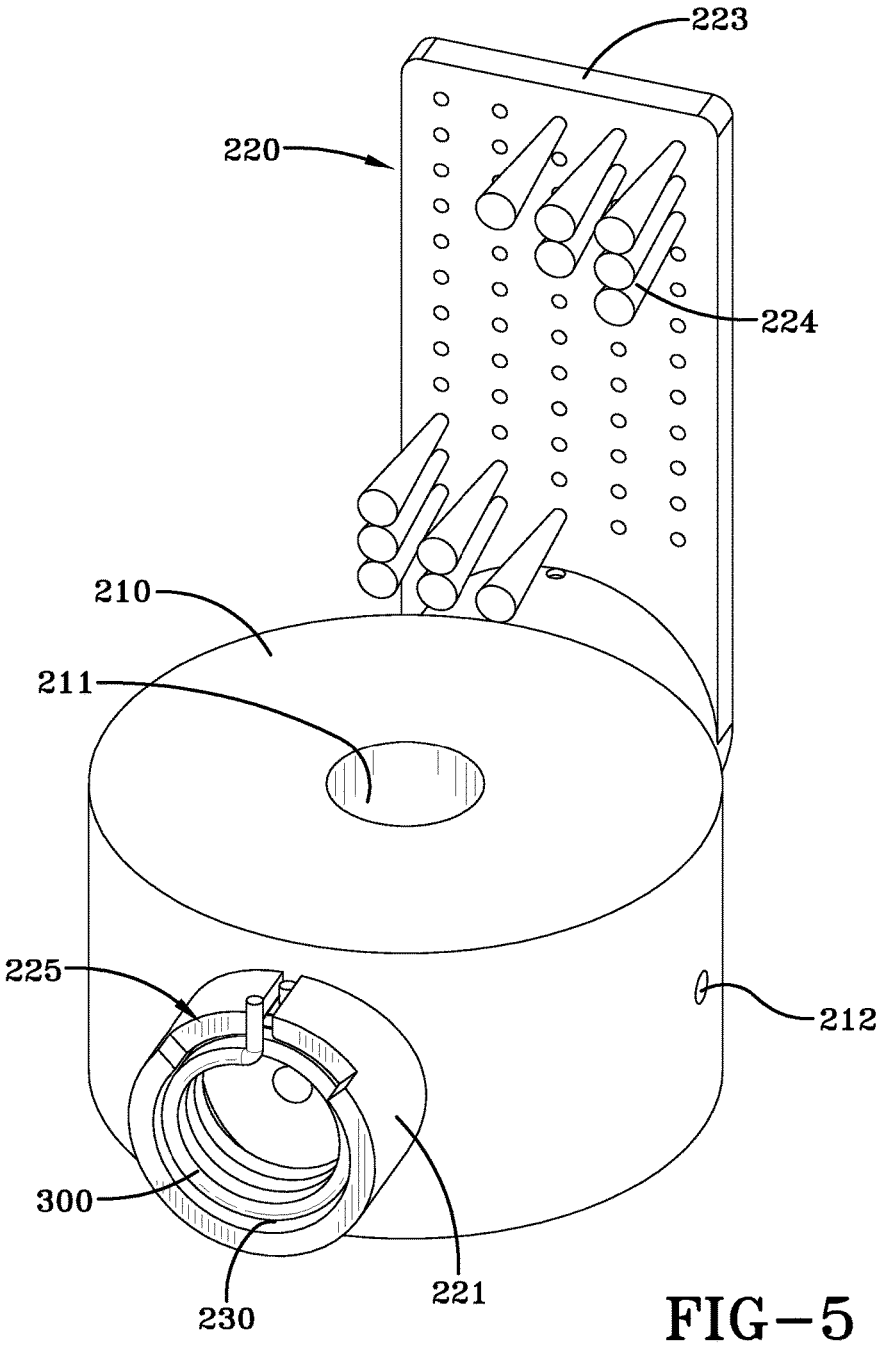
FIG. 5 is a third perspective view of a partially disassembled two-armed supplemental brush device shown in FIG. 3 with one brush removed showing detail of the spring-loaded rotation mechanism between the base and the brush arm.

FIG. 5 shows a third perspective view of the two-armed supplemental brush shown in FIGS. 3 and 4 with one of the upwardly extending support members removed to show the interior detail of the brush arm. Note that the curved double-headed arrow of FIG. 5 indicates the plane of rotation that the upwardly extending support member may travel along. The spacing member 221 has on its distal end an indentation 230 into which a torsion spring may be inserted that interacts with hole 226 to return the upwardly extending support member to an upright position should the upwardly extending support member rotate from the upright position. The opening 225 adjacent to indentation 230 dictates the range of motion that the torsion spring (see FIG. 9) may pass which is related to the rotatability of the upwardly extending support member.

Figure 6A:
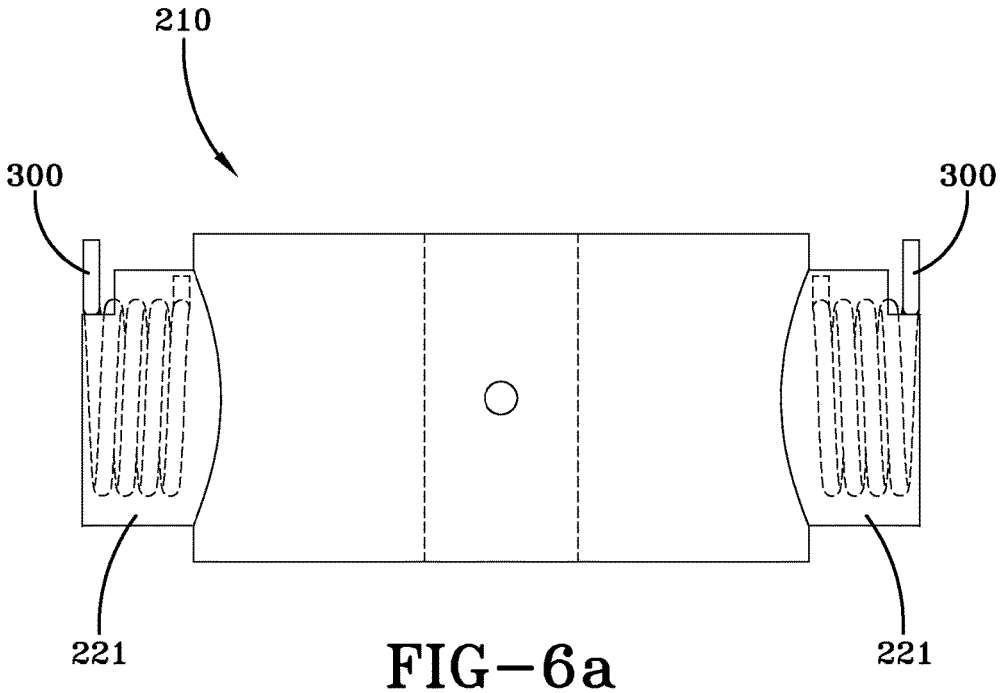
FIG. 6*a* is a front view of the base member and spacing members of the two-armed supplemental brush device.
Figure 6B:
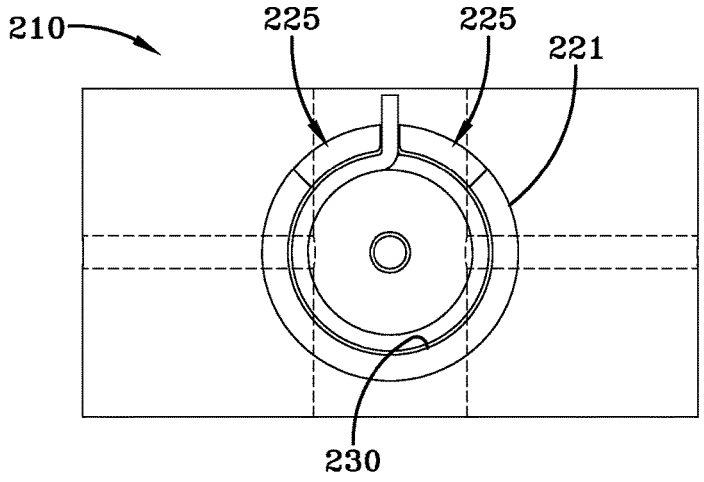
FIG. 6*b* is a side view of the base member and spacing members of the two-armed supplemental brush device.

FIG. 6*a* is a front view of the base member 210 and spacing member 221 of the two-armed embodiment shown in FIG. 5. FIG. 6*b* is a side view of the base member 210 and spacing member 221 of the two-armed embodiment shown in FIG. 5 including detail regarding the opening 225 dictating the range of motion of the torsion spring (see FIG. 9) resident in indentation 230.

Figure 7:
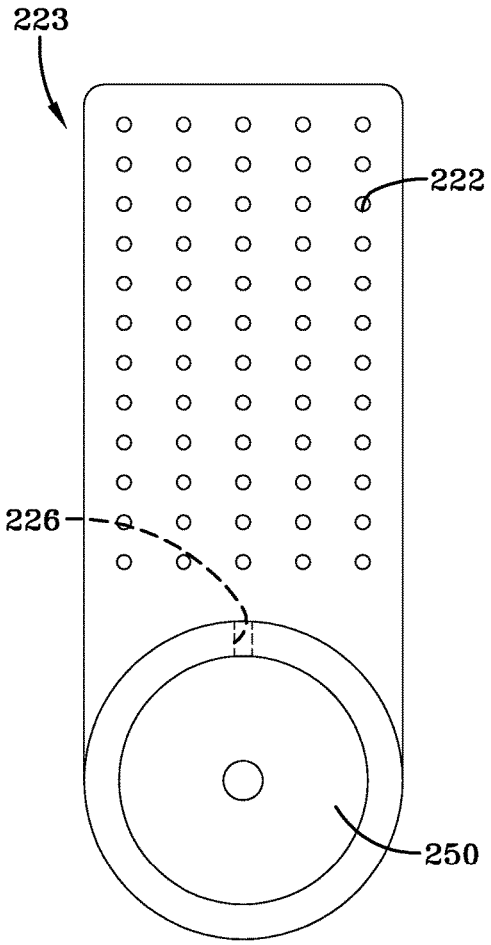
FIG. 7 is a front view of the upwardly extending support member of a brush arm of one embodiment.

FIG. 7 shows a front view of an upwardly extending support member 223. The spacing member 221 is inserted into cavity 250 and may be attached thereto by any conventional means, including an interference fit.

Figure 8:
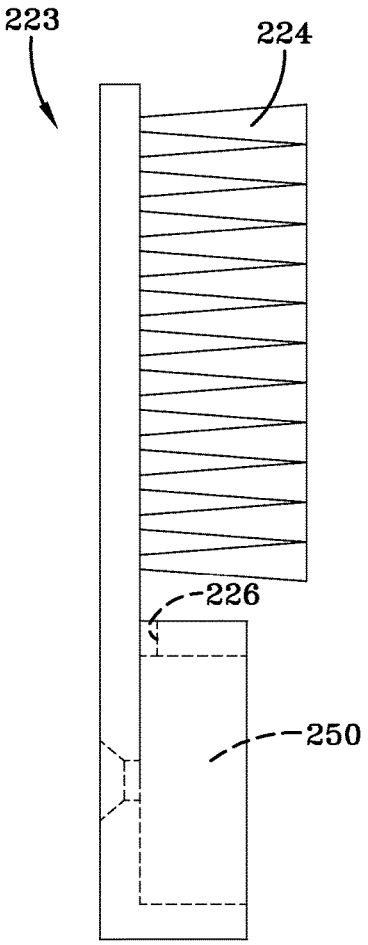
FIG. 8 is a side view of the upwardly extending support member of the brush arm shown in FIG. 7.

FIG. 8 shows a side view of an upwardly extending support member 223 providing additional views of bristle sets 224, hole 226, and cavity 250.

Figure 9:
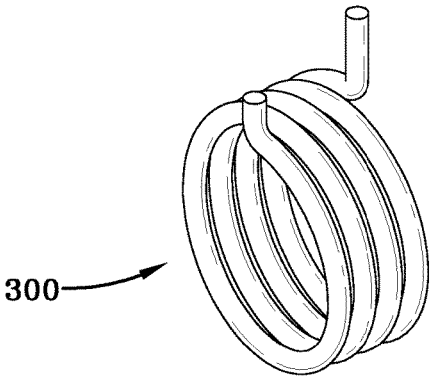
FIG. 9 illustrates a torsion spring used in the two-armed supplemental brush device shown in FIG. 3.

FIG. 9 shows one embodiment of a suitable torsion spring 300 that may be used in any embodiment of the present invention wherein the brush arms include a rotatable element, such as the upwardly extending support member shown in the embodiment of FIG. 3.

Although the rotatable elements (the upwardly extending brush arm) was disclosed in conjunction with a two-armed embodiment of the present invention, it should be noted that such rotatable elements may be used in embodiments having any number of arms, including 1-arm, 3-arm, and n-arm (where n is an integer).

Figure 10:
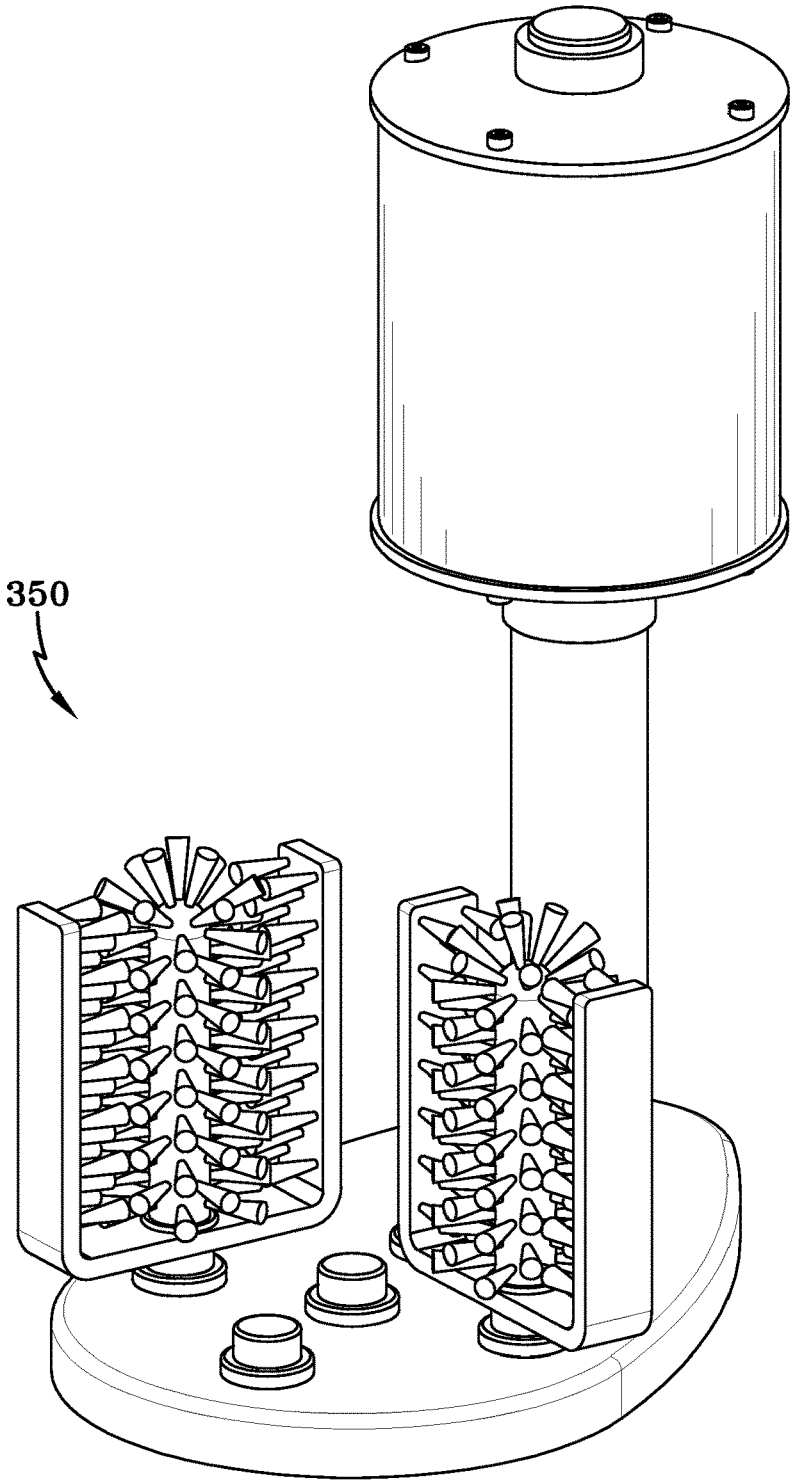
FIG. 10 is a perspective view of a submersible drinking vessel cleaner outfitted with two modified brush assemblies (i.e., the standard brush plus the two-armed supplemental brush device).
Figure 11:
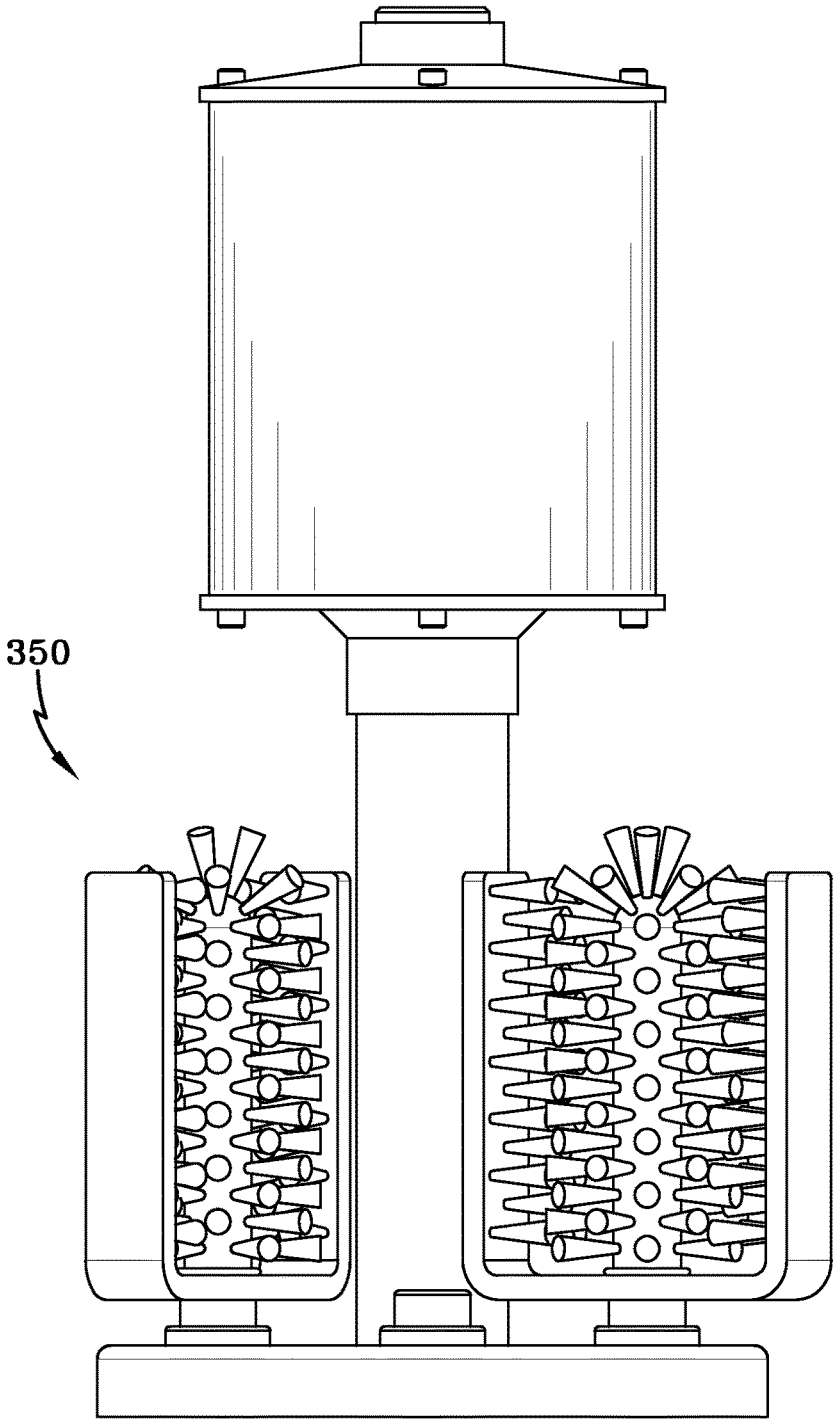
FIG. 11 is a front view of the submersible drinking vessel cleaner outfitted with two modified brush assemblies shown in FIG. 10.
Figure 12:
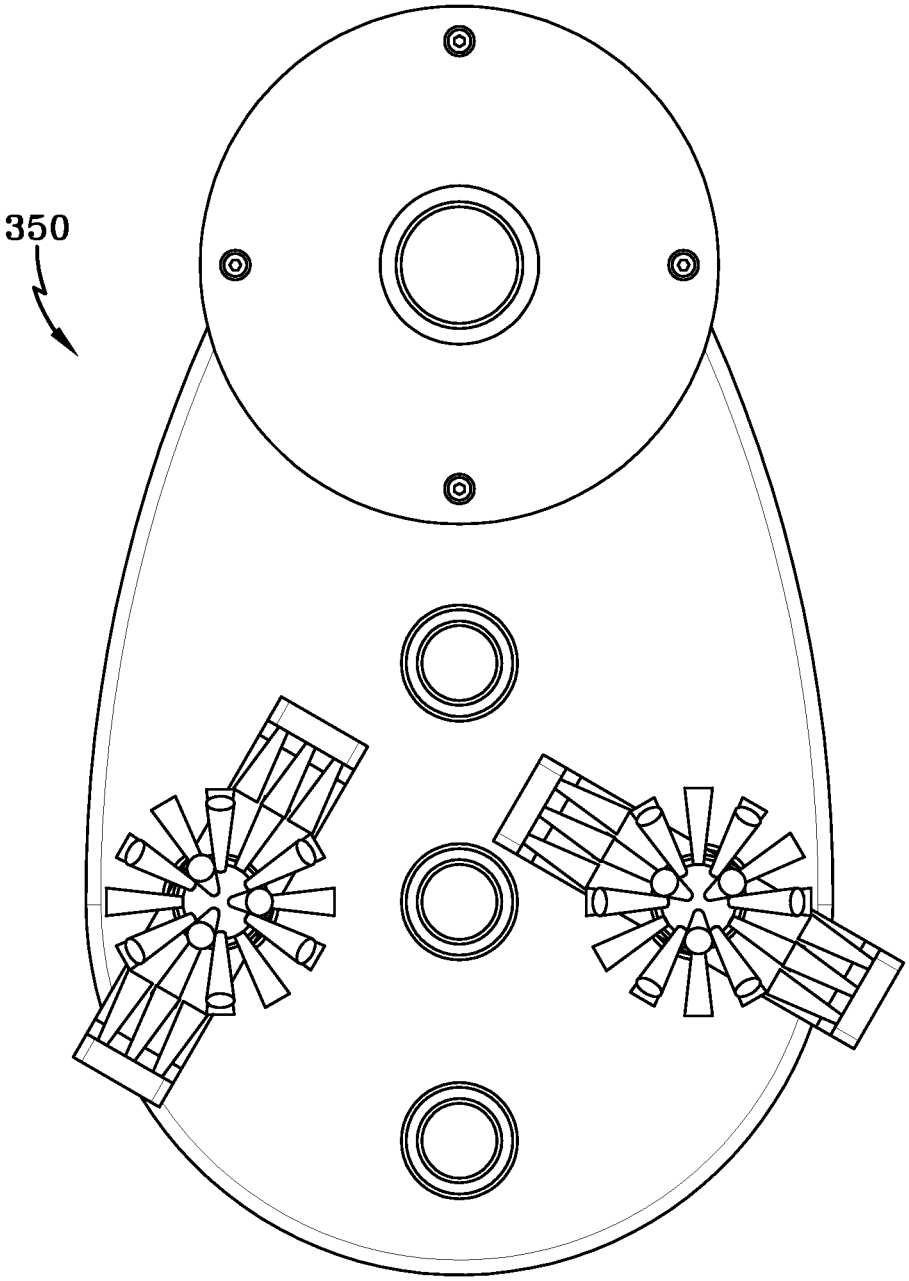
FIG. 12 is a top view of the submersible drinking vessel cleaner outfitted with two modified brush assemblies shown in FIG. 10.

The disclosed embodiments provide improved contact between the drinking vessel and the cleaning surfaces while delivering the increased throughput desired by users. FIG. 10 displays the use of two two-armed assembly embodiments 350 (an assembly embodiment comprises a brush, such as 12, affixed to a supplemental brush, such as 200) inserted into the outermost positions on the base of a conventional submersible drinking vessel cleaner thereby allowing a user to simultaneously and thoroughly wash two drinking vessels instead of washing a single drinking vessel (using the central brush) or incompletely washing two drinking vessels (by using side brushes and failing to completely scrub the exterior of the vessels). FIG. 11 shows a second view of a conventional submersible drinking vessel cleaner retro-fit with two of the two-armed assembly embodiments. FIG. 12 shows the position of the two two-armed assembly embodiments as used in conjunction with the base module 11 of FIG. 1. In operation, a user inserts brush 12 inside of a drinking vessel and the supplemental brush 118 or 200 extends outside of the drinking vessel so that as the assembly embodiment rotates on the base, the user can simultaneously clean the interior and exterior of the drinking vessel. Optionally, the drinking vessel is moved upward and downward during the process for more complete cleaning. When washing is complete, the drinking vessel is withdrawn and another drinking vessel is cleaned in the same way. Only a very short time is necessary for complete cleaning both internally and externally of a drinking vessel and because two assembly embodiments can be retro-fit to an existing base twice as many drinking vessels can be cleaned per unit of time than is presently accomplished.

Figure 13:
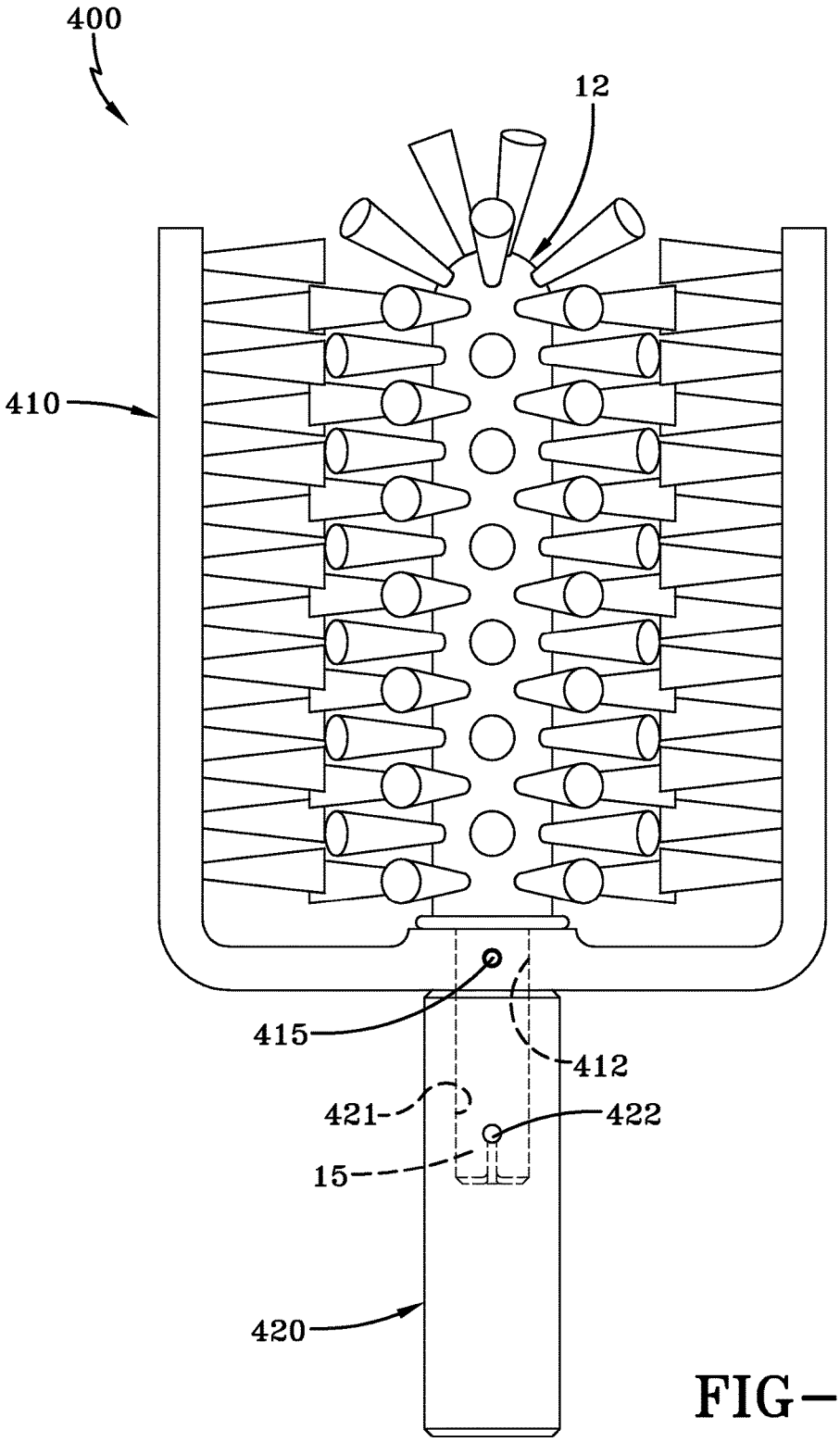
FIG. 13 shows a modified brush assembly attached to a handle for manual cleaning of drinking vessels.

FIG. 13 displays a hand-operable embodiment 400. As shown in FIG. 13, a brush 12 is inserted through passage 412 and a pin 415 is inserted through an opening on the supplemental brush 410 that affixes the brush 12 to the supplemental brush 412. The lower portion of brush 12 is then inserted into a cavity 421 on handle 420 where the fork of clamp member 15 interacts with a post 422 to secure the brush 12 to the handle 420. In operation, a user inserts brush 12 inside of a drinking vessel and the supplemental brush 410 extends outside of the drinking vessel so that the user can rotate the handle 420 relative to the drinking vessel to simultaneously clean the interior and exterior of the drinking vessel. Optionally, the drinking vessel is moved upward and downward during the process for more complete cleaning. When washing is complete, the drinking vessel is withdrawn and another drinking vessel is cleaned in the same way. Only a very short time is necessary for complete cleaning both internally and externally of the drinking vessel.

Optionally, the brush 12 and supplemental brush device 410 may be integrally formed from a plastic or other suitable member to eliminate the need for the pin and for the use of port 14.

Figure 14:
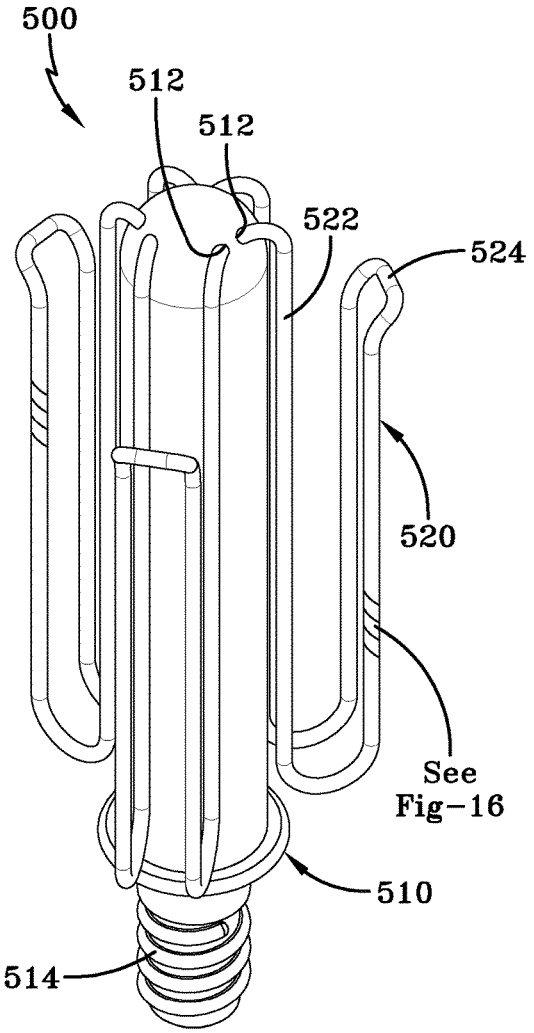
FIG. 14 presents a perspective view of an alternative embodiment of a three-armed brush device.

FIG. 14 displays an alternative embodiment of a three-armed brush 500. As shown in FIG. 14, brush 500 is formed from a body portion 510 and three brush arms 520. Each brush arm 520 is formed from a segment of double helix wire with a plurality of bristles extending therefrom (akin to a pipe cleaner). Each brush arm 520 is formed by bending the double helix wire segment into a "folded-over U-shaped" configuration such as that depicted in FIG. 14. The brush arms are attached to the body portion by, for example, inserting the terminal ends of the wire segment into holes 512 disposed on body portion 510. In this manner the brush arm is designed to simultaneously contact the inside and the outside of a drinking vessel as the drinking vessel fits within the interior brush portion 522 and exterior brush portion 524 of each brush 520.

The body portion 510 may have disposed at one end a series of threads 514 such that the brush may be used in conjunction with conventional submersible drinking vessel cleaners (as shown, e.g., in FIG. 1*a*) or with static glass cleaners (as shown, e.g., in FIG. 1*c*). Alternatively, the threads 514 may be replaced by a clamp member (as shown, e.g., as element 15 in FIG. 1*b*).

Figure 15:
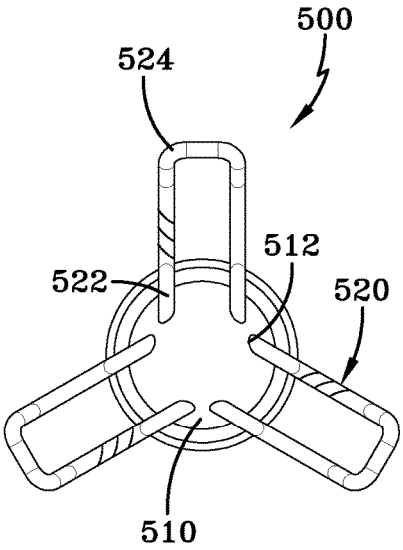
FIG. 15 shows a top view of the three-armed brush device shown in FIG. 14.

FIG. 15 is a top view of the embodiment 500 shown in FIG. 14. As depicted, the brush 500 has a body portion 510 and three brush arms 520. Each brush arm is inserted into a pair of holes 512 disposed at the top end of the body portion. Each brush arm has an interior brush portion 522 that is proximal to the body portion when the brush arm is attached to the body portion and an exterior brush portion 524 that is distal to the body portion when the brush arm is attached to the body portion. When embodiment 500 is used to clean a drinking vessel, at least a portion of the drinking vessel is placed between the interior brush portion(s) 522 and the exterior brush portion(s) 524 such that a brush simultaneously contacts the interior and exterior of the drinking vessel.

Figure 16:
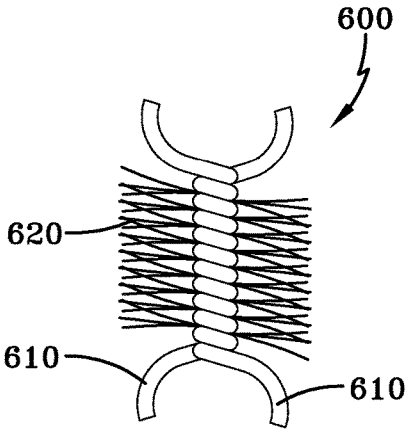
FIG. 16 is a close-up of the double helix wire with bristles extending therefrom used to form the arms of the three-armed brush device shown in FIGS. 14 and 15.

FIG. 16 displays a portion of a double helix wire segment with bristles 600 (individual wires identified as 610 and bristles as 620) that may be used to form the brush arms of the embodiment illustrated in FIGS. 14 and 15 above.

Figure 17:
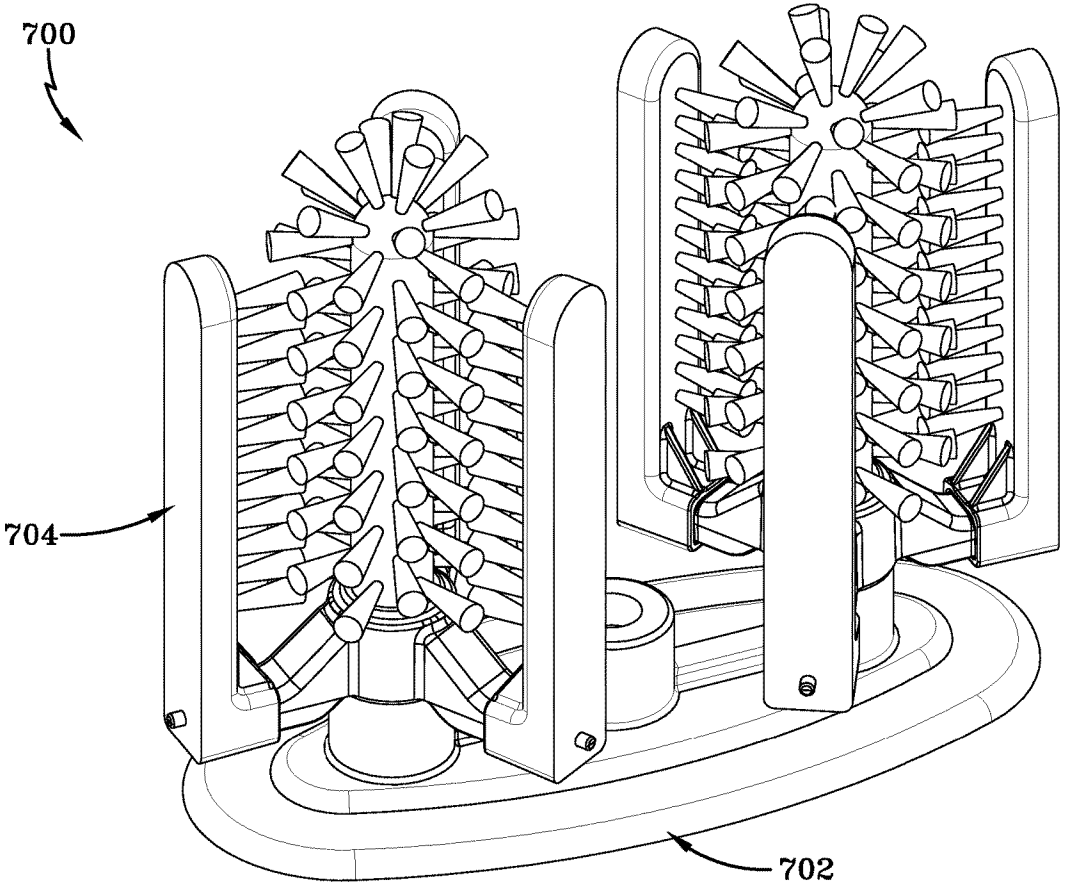
FIG. 17 presents a static glass cleaner assembly using a three armed embodiment of the present invention.

FIG. 17 shows an assembly unit 700 formed from static base 702 and two brush assemblies 704. The bottom of the static base 702 may have a configuration that allows it to experience mild suction on a smooth surface such as a sink or countertop to prevent the unit from movement during use.

Figure 18:
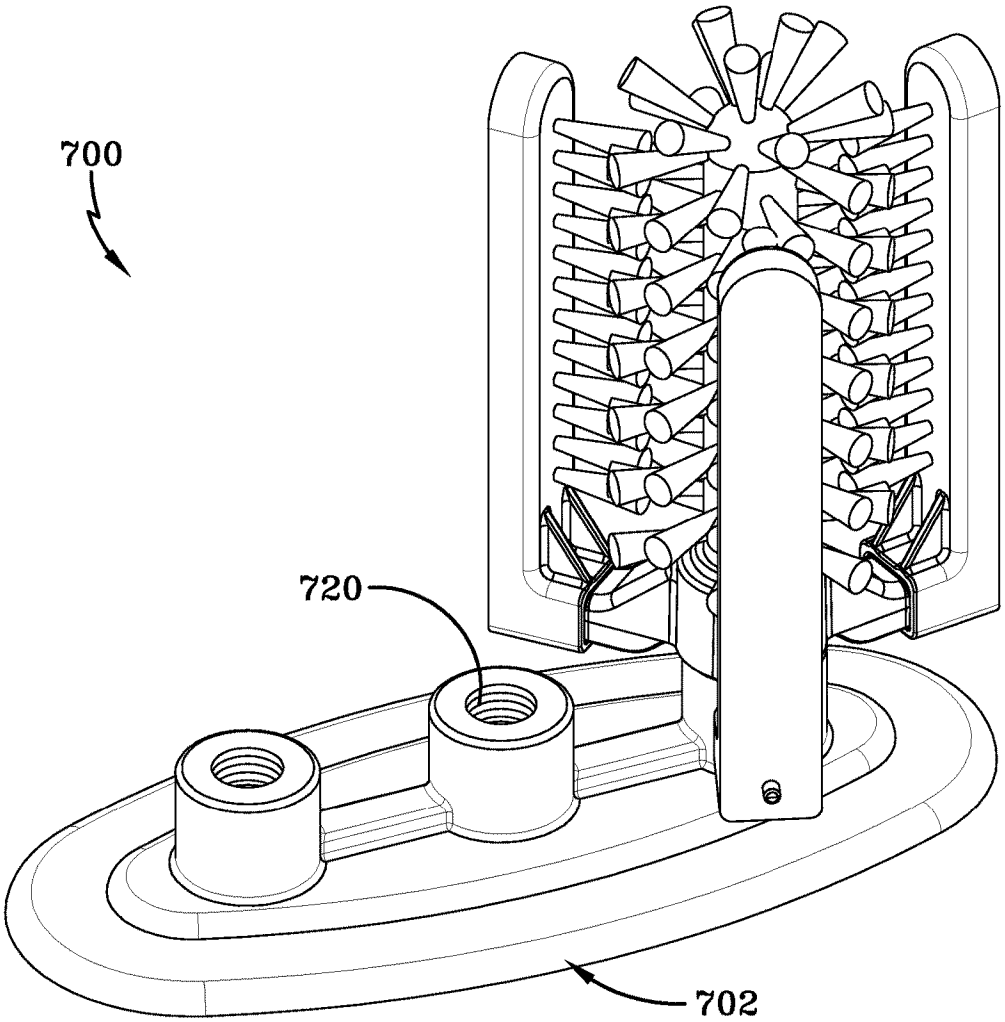
FIG. 18 presents a second view of the static glass cleaner assembly of FIG. 17.

In FIG. 18 one brush assembly 704 has been removed to show threaded blind hole 720. The static base may have any number of such blind holes although it is preferred that the static base possess two such holes.

Figure 19:
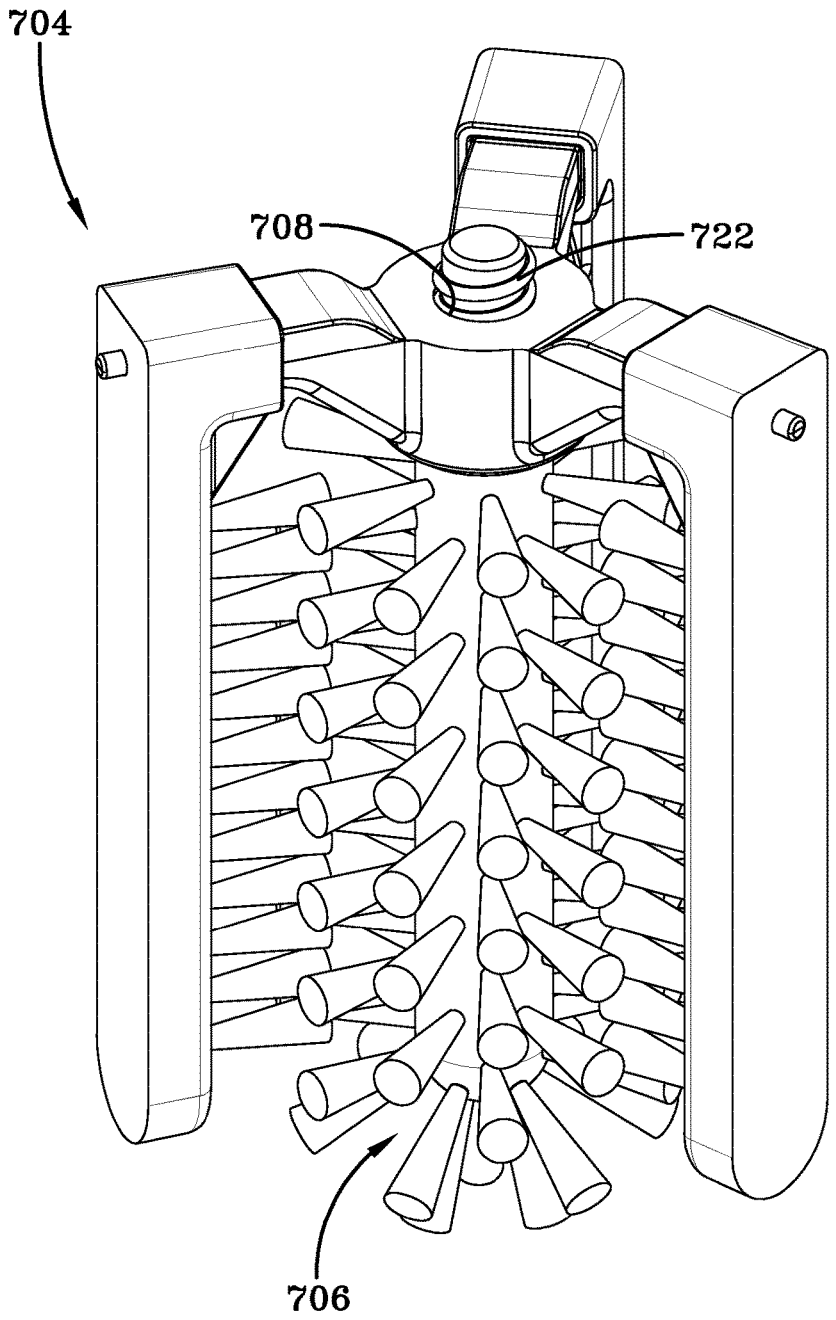
FIG. 19 presents a view of a brush assembly unit in accordance with one embodiment of the present invention.

FIG. 19 provides an inverted illustration of brush assembly 704. Central brush 706 extends through a bore in base member 708 and terminates in threaded portion 722. Threaded portion 722 is used to secure the brush assembly to the static base. When the threaded portion of the central brush is screwed into the blind hole of the static base and tightened, the brush assembly is secured to the static base. Although a threaded portion is shown in FIG. 19, the threaded portion could be replaced by any of a clip, clamp or post structure so long as a complimentary structure is used in the blind holes of the, e.g., static base such that the brush assembly can be affixed to thereto.

Figure 20:
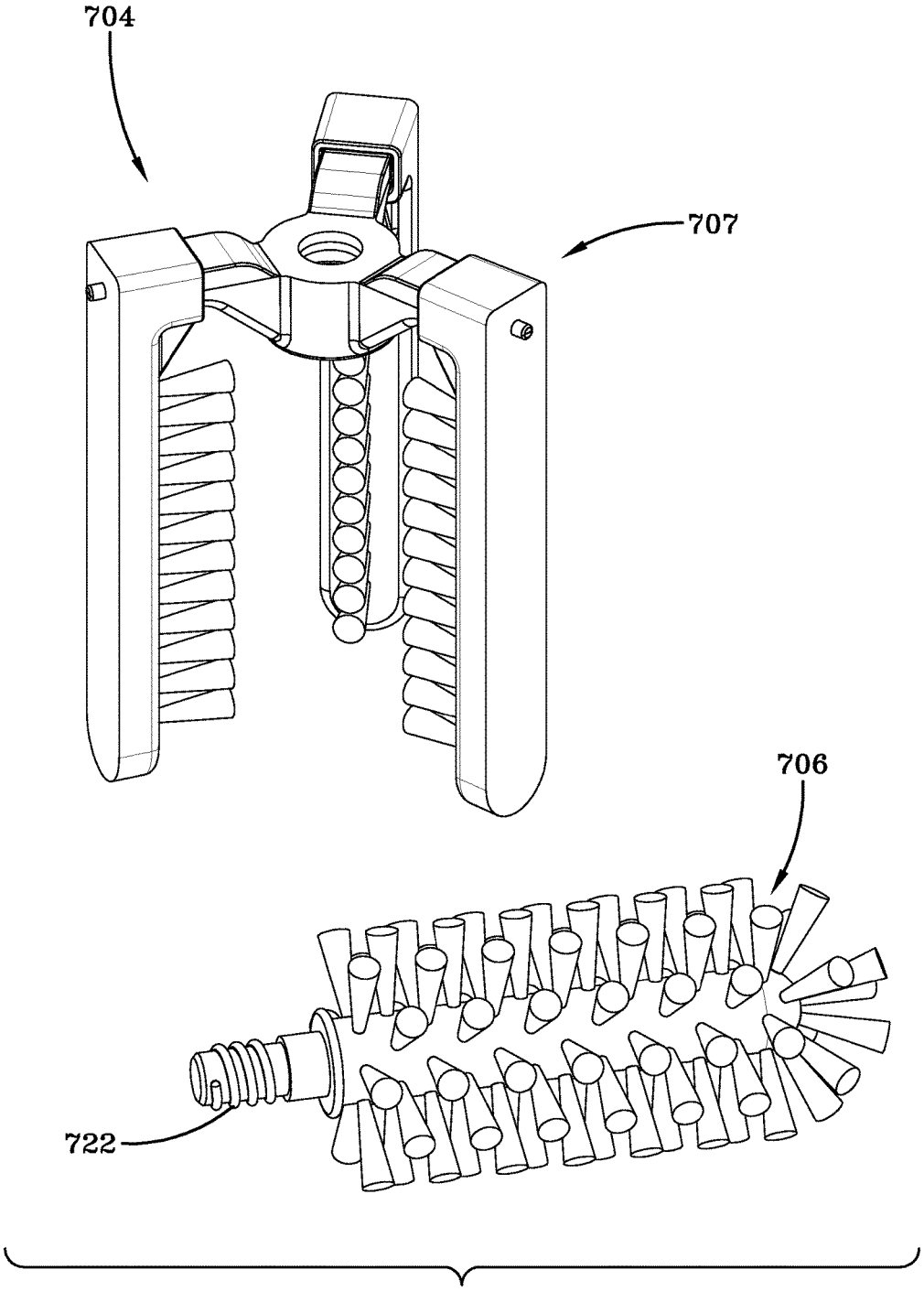
FIG. 20 shows the components of the brush assembly shown in FIG. 19.

FIG. 20 shows the components of brush assembly 704, namely central brush 706 and the supplemental brush unit 707.

Figure 21:
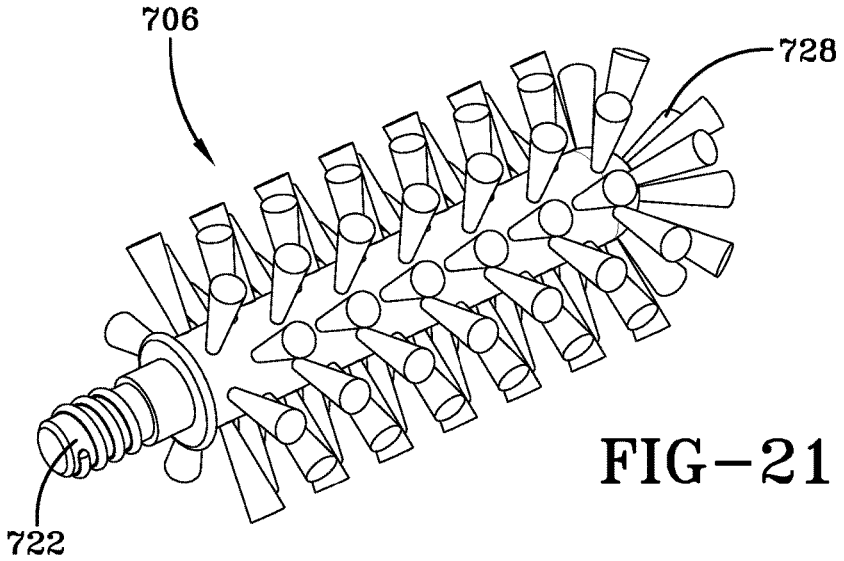
FIG. 21 shows a central brush component in accordance with one embodiment of the present invention.

FIG. 21 shows central brush 706 and the threaded portion 722 disposed on the opposing end from bristles 728.

Figure 22:
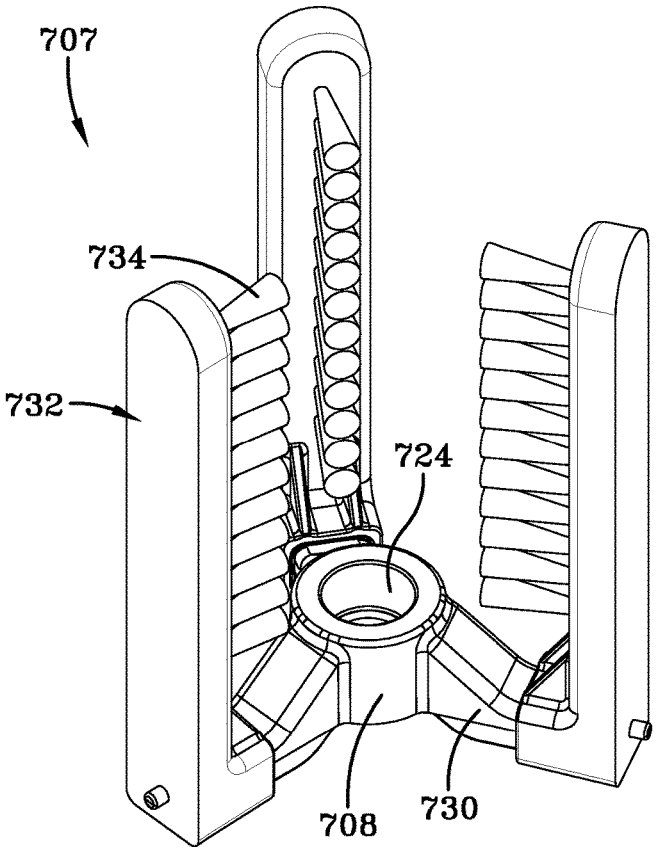
FIG. 22 shows a three armed embodiment of a supplemental brush component in accordance with one embodiment of the present invention.

FIG. 22 illustrates the supplemental brush 707 formed from base member 708, three spacing members 730 disposed about the periphery of base member 708, and three bristle-bearing support members 732. Bristles 734 are disposed such that they generally face inwardly towards the axis of the bore 724 in base member 708.

In use, the assembly unit 700 is placed in a sink and the sink filled with soapy water until the unit is almost completely submerged. When it is time to clean a cup, the cup is inverted and lowered over a central brush such that the wall of the cup fits between the bristles of the central brush and the bristles of the support members. The cup can then be rotated by hand in a back-and-forth motion such that the interior and exterior of the cup are simultaneously cleaned. Once a sufficient number of rotations to clean the cup have been made the cup can be withdrawn from the unit and rinsed.

Figure 23:
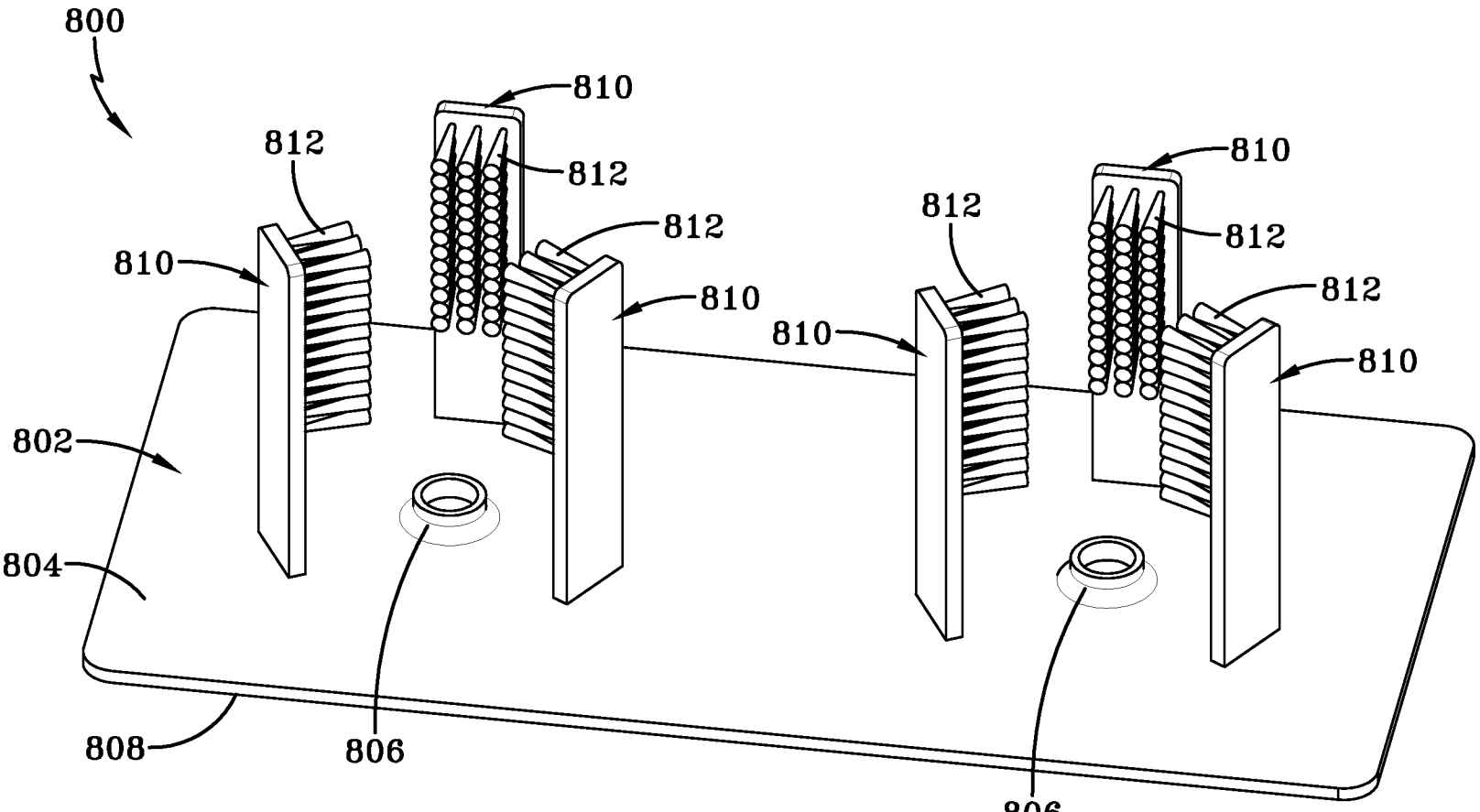
FIG. 23 shows a mat based configuration in accordance with one embodiment of the present invention.

FIG. 23 presents a mat-based embodiment 800 of the present invention. The mat 802 has one or more central brush connectors 806 disposed on its upper surface 804 and its lower surface 808 may be configured so as to experience suction when placed on a smooth surface such as in a sink basin or countertop. Circumferentially disposed about each central brush connector 806 are one or more bristle-bearing support members 810 that rise vertically from the mat 802. The support members 810 may be integrally formed with the body of the mat or may be separately formed and later affixed to the mat using an adhesive, ultrasonic welding, mechanical connectors or the like. Alternatively, the support members could be placed through openings in the mat.

Typically, the support members 810 associated with a given central brush connector are each the same distance from one another. In other words, if there are three support members they are 120 degrees from one another, while if there are four support members they are 90 degrees from one another. However, the support members 810 may be unequally spaced apart from one another or from the central brush connector itself. The bristles 812 on the support members 810 are oriented so as to point inwardly toward the axis of the central brush connector 806.

Each central brush connector 806 is adapted so as to connectively attach a central brush—such as the central brush 706 shown in FIGS. 19, 20 and 21. For example, the central brush connector may have a female threaded portion that engages a male threaded portion at the bottom of the brush. In this manner, a central brush may be mounted to the mat so that the exterior of a glass positioned over the central brush will encounter the bristles 812 of the surrounding support members 810. The central brush connector may comprise a pin, clip, clamp, threaded structure or the like that provides a complementary fit to structure on the lower end of a central brush to ensure Alternatively, the central brush connector 806 maybe a projection that fits within an opening on the bottom of a brush to affix it to the mat 802.

Each brush, brush assembly or integrally formed brush/supplemental brush combination described herein may be suitably used with a conventional submersible drinking vessel cleaner, as shown in FIG. 10, or substituted in the static submersible drinking vessel cleaners, for example those shown in FIG. 1*c* above.

Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided herein is intended merely to better illuminate the disclosed embodiments and does not pose a limitation on the scope of the disclosed embodiments unless otherwise claimed. No language in the specification should be construed as indicating any non-claimed element essential to the practice of the disclosed embodiments or any variants thereof.

Groupings of alternative elements or embodiments disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability Preferred embodiments of this invention are described herein, including the best mode known to the inventors for carrying out the invention(s). Of course, variations on the disclosed embodiments will become apparent to those of ordinary skill in the art upon reading the foregoing description. The inventors expect skilled artisans to employ such variations as appropriate, and the inventors intend for the invention(s) to be practiced otherwise than specifically described herein. Accordingly, this disclosure includes all modifications and equivalents of the subject matter recited in the claims appended hereto as permitted by applicable law. Moreover, any combination of the above described elements in all possible variations thereof is encompassed by the disclosed embodiments unless otherwise indicated herein or otherwise clearly contradicted by context.

Having shown and described an embodiment of the invention, those skilled in the art will realize that many variations and modifications may be made to affect the described invention and still be within the scope of the claimed invention. Additionally, many of the elements indicated above may be altered or replaced by different elements which will provide the same result and fall within the spirit of the claimed invention. It is the intention, therefore, to limit the invention only as indicated by the scope of the claims.

What is claimed is:

1. A device for cleaning a drinking glass having interior and exterior surfaces, the device comprising:

a body having a top portion and bottom portion;

an elongate cleaning member extending from the top portion and travelling downwardly towards the bottom portion of the body, turning near the bottom portion of the body and travelling upwardly, turning again near the top portion of the body and travelling downwardly, turning again near the bottom portion of the body and travelling upwardly, and finally attaching to the top portion of the body; and threads placed near the bottom portion of the body.

2. The device of claim 1 further comprising a static base having a female threaded hole which accepts the threads on the body.

3. The device of claim 1 further comprising a handle attached near the bottom portion of the body.

4. The device of claim 1 wherein the elongate cleaning member is a wire.

5. The device of claim 1 wherein the elongate cleaning member is a pipe cleaner.

6. The device of claim 1 wherein the elongate cleaning member is a pair of wires formed into a helix.

7. The device of claim 1 further comprising a plurality of bristles extending from the elongate cleaning member.

8. The device of claim 1 wherein the elongate cleaning member contacts both the interior surface and exterior surface of a glass when the body is inserted into the glass.

* * * * *